US005552663A

United States Patent [19]

Iida et al.

[11] Patent Number: 5,552,663

[45] Date of Patent: Sep. 3, 1996

[54] CATHODE RAY TUBE APPARATUS

[75] Inventors: Koichi Iida; Michihisa Yano, both of Kanagawa, Japan

[73] Assignee: Sony Corporation, Japan

[21] Appl. No.: 310,325

[22] Filed: Sep. 22, 1994

[30] Foreign Application Priority Data

Sep. 29, 1993 [JP] Japan ..... 5-243344

[51] Int. Cl.[6] ..... H01J 29/18

[52] U.S. Cl. ..... 313/461; 313/463; 348/805

[58] Field of Search ..... 313/461, 407, 313/477 R, 463, 466; 348/781, 796, 805, 832; 359/451, 460, 453, 456

[56] References Cited

U.S. PATENT DOCUMENTS 2,172,775 9/1939 Schmidt-ott et al. ..... 348/781
4,409,515 10/1983 Kloss ..... 313/477 R
4,904,899 2/1990 Nakata et al. ..... 313/477 R
5,353,070 10/1994 Mitani et al. ..... 348/781

*Primary Examiner*—Kenneth A. Wieder
*Assistant Examiner*—Ashok Patel
*Attorney, Agent, or Firm*—Ronald P. Kananen

[57] ABSTRACT

The present invention enlarges the effective display area of a CRT for projecting while maintaining the strength of the panel necessary to allow for normal usage without breaking. The inside portion of the effective display area inside the rectangular display area is of a predetermined radius, and protrudes inward, extending in all directions. The four corners of the display area are outside of the circular boundary line comprised of the standard thickness Tf. Non-display areas H which are outside the boundary line are flat or protuberant, and have a thickness greater than the standard thickness Tf. Accordingly, with the present invention, the effective display area A2 can be made larger than previous effective display areas A1 in the prior art, which could not extend beyond a border that included the four corners, while maintaining overall the necessary strength.

13 Claims, 7 Drawing Sheets

CATHODE RAY TUBE APPARATUS

BACKGROUND OF THE INVENTION

This invention relates to a CRT (cathode-ray tube) for projecting having a panel concaved on the inside (a panel display).

DESCRIPTION OF THE RELATED ART

FIG. 1 illustrates a projector in the related art. In a typical rear projector 1, a video image displayed on a CRT for projecting 2 is magnified by a lens 3, reflected from a mirror 4, and projected onto a screen 5. As shown in FIG. 2, the CRT for projecting 2 comprises a glass tube 10 for displaying the video image, an electron gun 21 built into the glass tube 10, a deflection yoke 22, and so on.

The glass tube 10 consists of a panel 11 which is rectangular in shape in front having a display area 14 onto the inside of which a phosphor is coated, and a funnel 12. A frit seal 13 is welded between the panel 11 and the funnel 12 so that the glass tube 10 is closed tightly. The electron gun 21 mounted in the neck 12A of the funnel 12 emits an electron beam, corresponding to a video signal, which is deflected by the deflection yoke 22 and scanned horizontally and vertically so as to be projected onto the phosphor inside the display area 14. In such fashion, the video image is displayed in the display area 14.

The panel 11 is either a panel 11 concaved on the inside, as illustrated in FIG. 3A, or a panel 11*a* flat on the inside, as illustrated in FIG. 3B. The inside portion of the display area 14 of the panel 11 concaved on the inside protrudes inward in an arc shape, extending in all directions with a predetermined radius R1 of, for example, approximately 350 mm. In other words, the inside portion of the display area 14 is a part of the spherical surface. On the other hand, with the panel 11*a*, the inside portion of the display area 14 is flat on the inside.

In the case of the panel 11 concaved on the inside, the thickness T1 of the center of the display area 14 is fixed based on optical conditions, and the thickness T2 of the peripheral area surrounding the display area 14 must be set at a greater thickness than the standard thickness Tf of, for example, 5 to 6 mm. In this way, the size of the effective screening area of the display area in which the video image is normally displayed is restricted.

On the other hand, the recent CRTs for projecting require high luminance and high resolution and it has become necessary to enlarge the effective screening area A1. However, as described above, the restriction on the display size causes difficulties.

Although it is possible to widen the effective screening area AI while maintaining the standard thickness Tf by increasing the radius R1 of the display area 14, the video image cannot be displayed normally because the optical conditions are changed through said widening.

It is to be noted that the terms "screening area," "non-screening area," and "outlines," as used throughout this application, refer to "display area," "non-display area," and "boundaries," respectively.

OBJECT AND SUMMARY OF THE INVENTION

It is accordingly an object of this invention to provide an improved CRT for projecting in which the effective screening area can be enlarged without changing the optical condition.

In order to solve the problem described above, a CRT for projecting, according to the present invention, having a panel concaved on the inside has the effective screening area having a thickness greater than the standard thickness, and the non-screening area, which is outside the effective screening area and formed such that the inside portion of the non-screening area is flat or protuberant so as to allow the non-screening area to have a thickness greater than the standard thickness.

These and other objects and many of the attendant advantages of this invention will be readily appreciated as the same becomes better understood by reference to the following detailed description, considered in conjunction with the accompanying drawings.

DESCRIPTION OF THE PREFERRED EMBODIMENT

A CRT for projecting, according to this invention, is described below with reference to the drawings.

In the following description, the terms "screening area, " "non-screening area," and "outlines" refer to "display area," "non-display area," and "boundaries," respectively.

Figure 1:
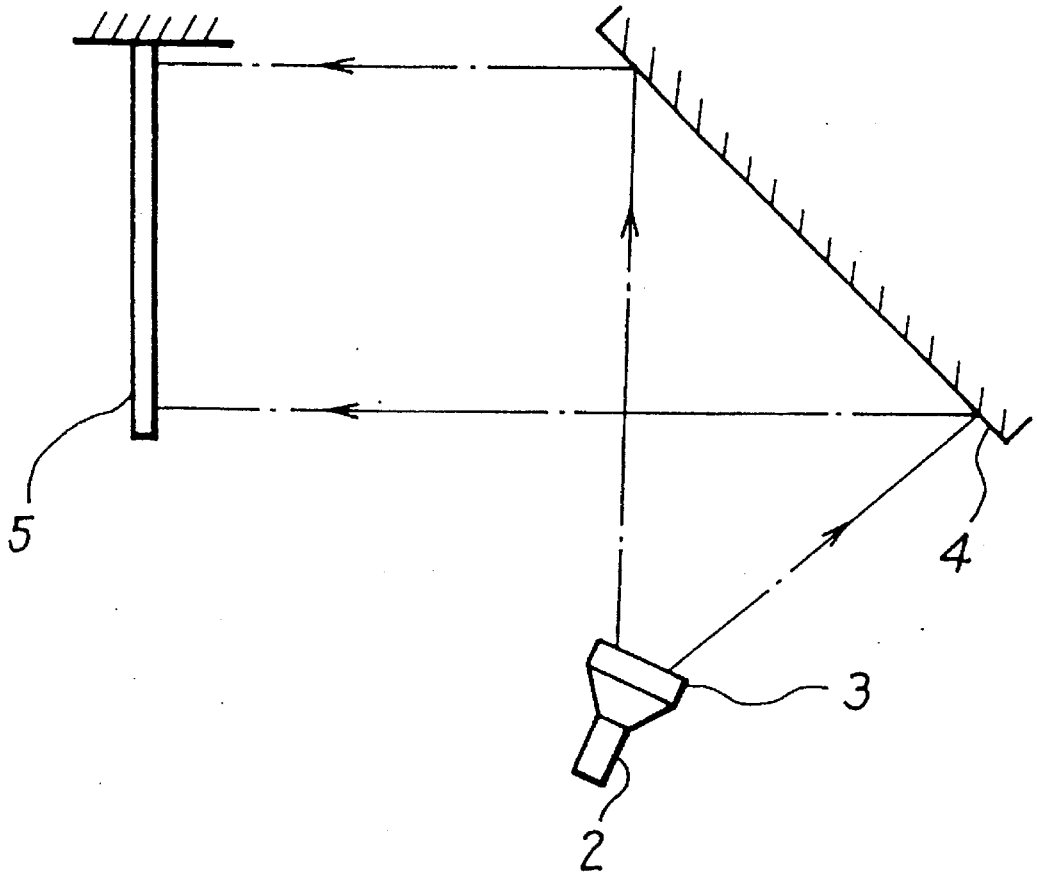
FIG. 1 (RELATED ART)
FIG. 1 is a diagram illustrating the structure of a typical rear projector in the related art.
Figure 2:
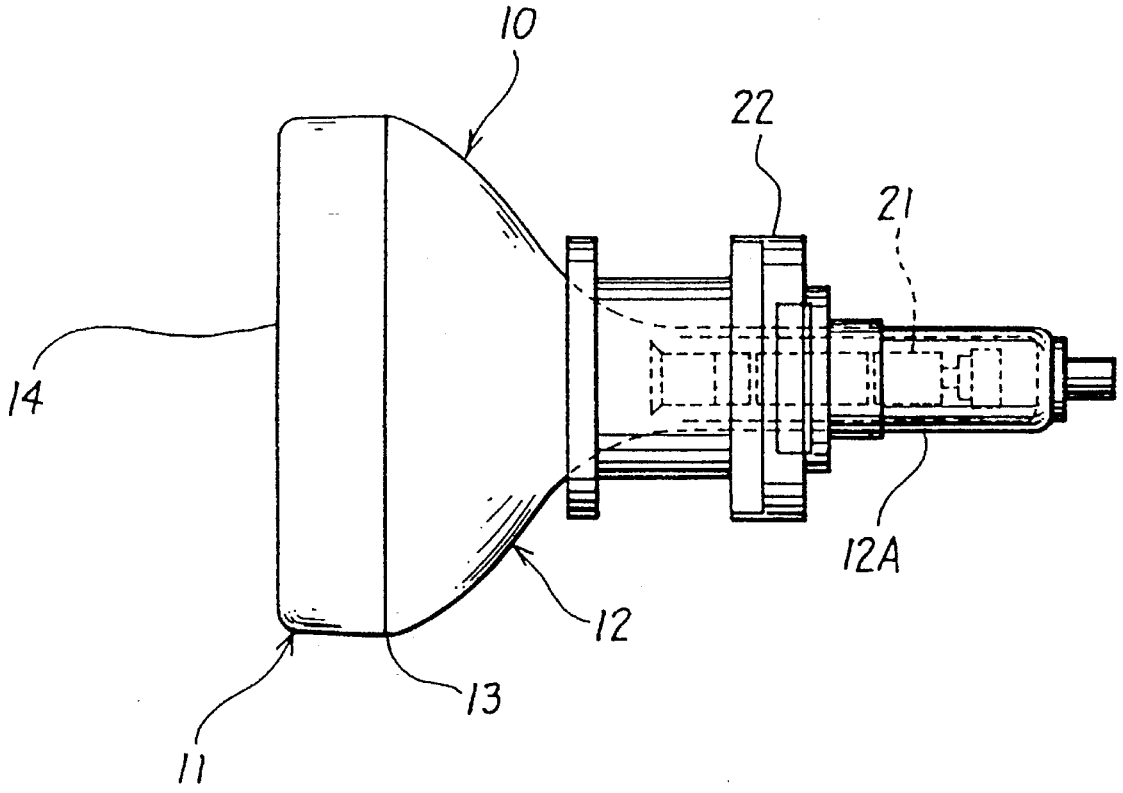
FIG. 2 (RELATED ART)
FIG. 2 is a diagram illustrating the structure of the typical CRT for projecting in the related art.
Figure 3A:
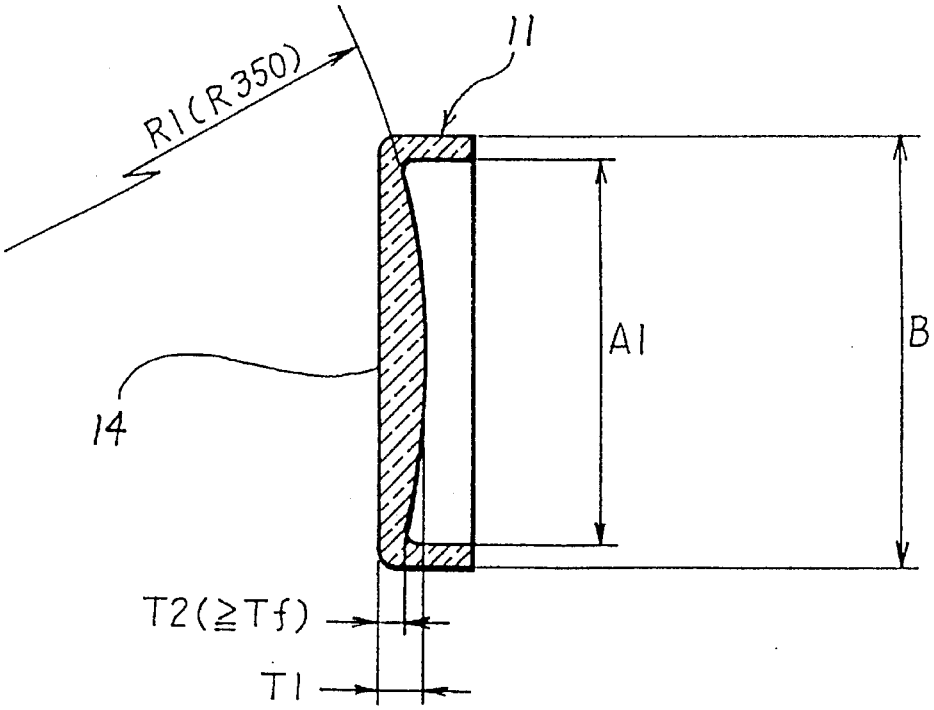
FIG. 3A (RELATED ART)
FIG. 3A and 3B are diagrams illustrating sectional views of the panel in the related art.
Figure 3B:
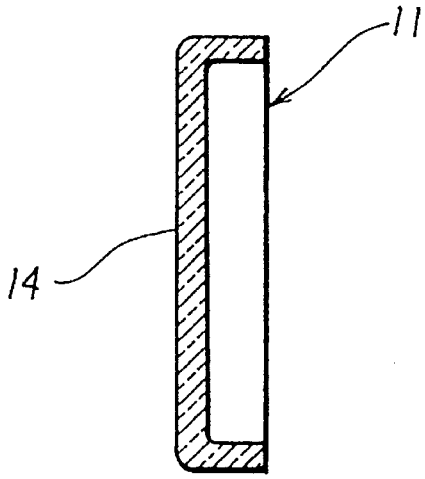
FIG. 3B (RELATED ART)
Figure 4:
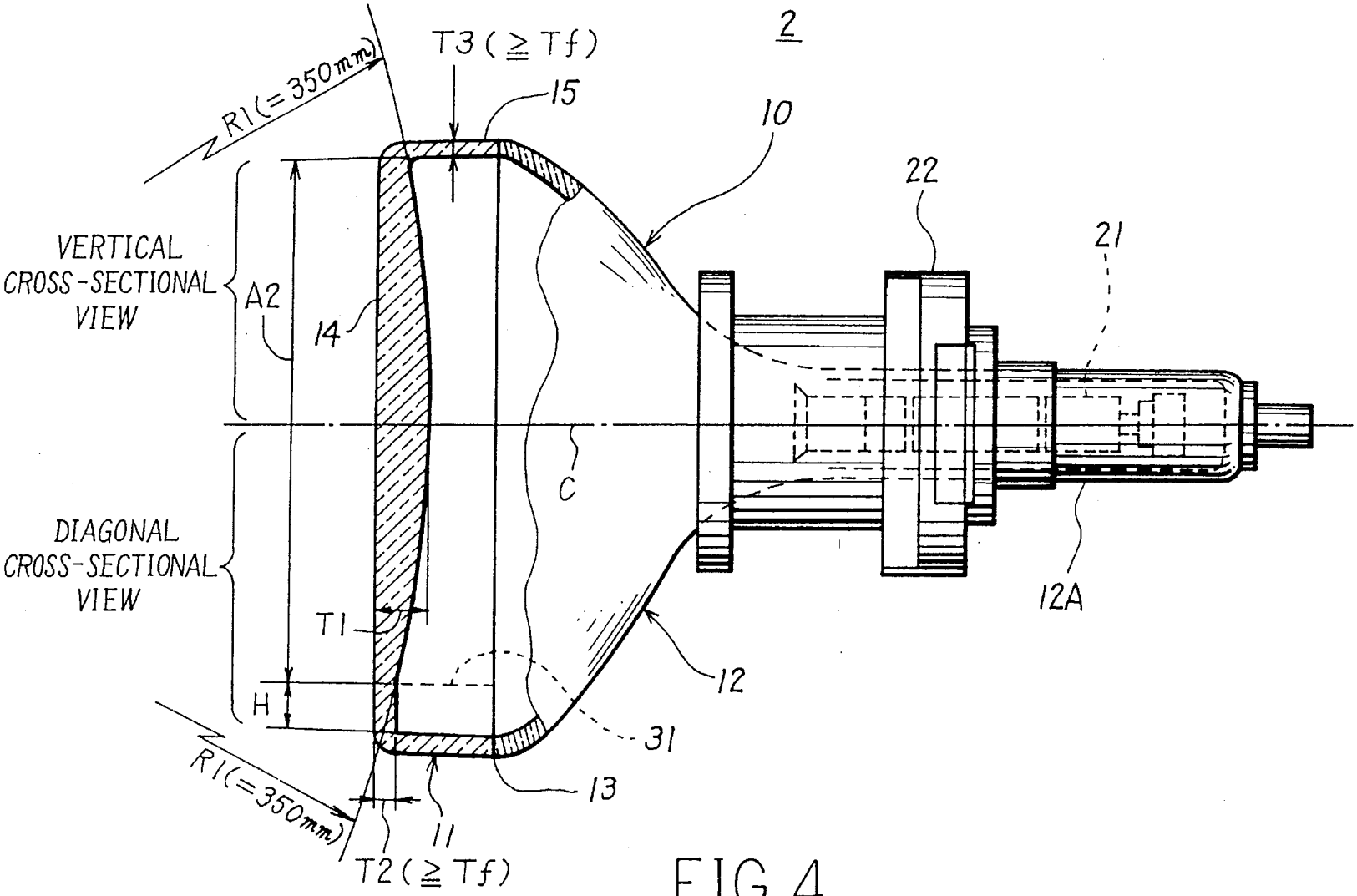
FIG. 4 is a diagram illustrating the structure of a CRT for projecting in the first embodiment according to the present invention.
Figure 5:
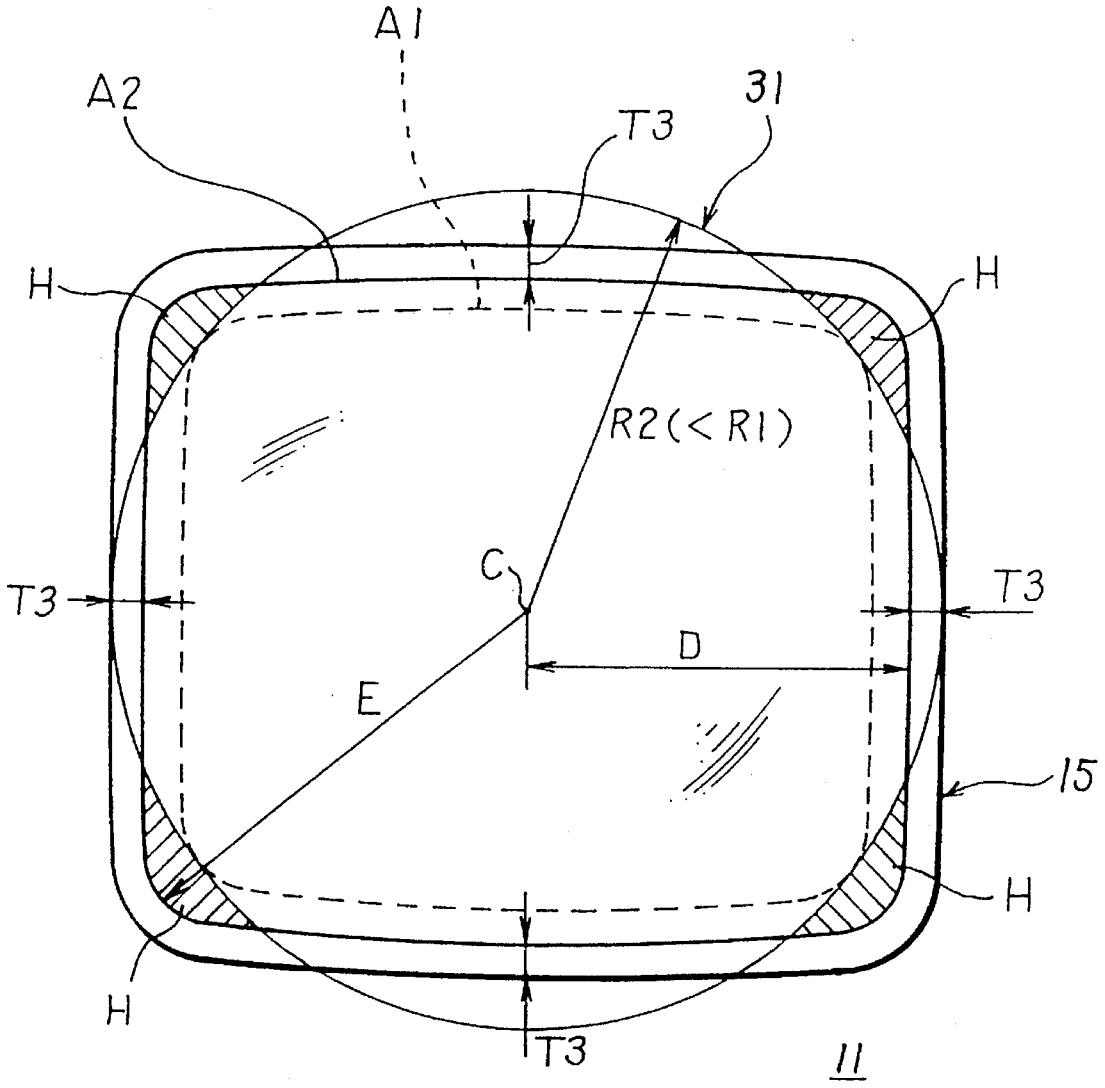
FIG. 5 is a rear elevation diagram illustrating a panel for explaining an effective screening area.

As shown in FIG. 4, the inside portion of the effective screening area A2 inside the rectangular display area 14 of the panel 11 protrudes inward in an arc shape, extending in all directions, at a predetermined radius R1 and has a predetermined thickness T1 at the center. As shown in FIG. 5, the four corners of the display area 14 are outside of a circular boundary line 31 that establishes the standard thickness Tf for the strength necessary to allow for normal usage without breaking. Non-screening areas H which are outside the boundary line 31 and outside the predetermined radius R1 are flat or protuberant and have a greater thickness than the standard thickness Tf.

Thus, according to this invention, the effective screening area of the panel 11 can be made larger than the conventional effective screening area A1, which the conventional effective screening area had to be smaller than the boundary line 31, including the four corners, while maintaining necessary strength.

One embodiment of a CRT for projecting, according to this invention, is described below with reference to the drawings. In the following, the same reference numerals will denote the parts previously described, and detailed descriptions will be omitted.

FIG. 4 illustrates the structure of a CRT for projecting 2 in accordance with this invention. The CRT for projecting 2 comprises a glass tube 10, an electron gun 21 built in the glass tube 10, a deflection yoke 22, and so on. The glass tube 10 consists of a panel 11 concaved on the inside and a funnel 12. A frit seal 13 is welded between the panel 11 and the funnel 12 so that the glass tube 10 is closed tightly. The electron gun 21 and the deflection yoke 22 are mounted in the neck 12A of the funnel 12.

The panel 11 comprises the rectangular display area 14 and the rim 15 surrounding the display area 14. FIG. 4 is a vertical cross-sectional view (above the center line C) and a diagonal cross-sectional view (below the center line C) of the panel 11. The inside portion of the display area 14 of this panel 11 protrudes inward in an arc shape, extending in all directions, with a predetermined radius R1 (for example, in this embodiment, R1=350 mm). The display area 14 is a part of the spherical surface, excluding four corners of the non-screening areas H. The center portion of the display area 14 has a predetermined thickness T1, and the thickness T2 of the non-screening areas H and the thickness T3 of the rim 15 are greater than the thickness of the standard thickness Tf.

The panel 11 has a boundary line 31 describing a circle with center at the center of the display area 14 with a radius R2, and has the standard thickness Tf at the circumference as shown in FIG. 5. The radius R2 of the boundary line 31 is determined by the radius R1 of the protruding arc and the thickness T1 of the center of the display area 14. As described above, the conventional effective screening area A1 is small, including the four corners, as shown with a dotted line. On the other hand, in the embodiment, the non-screening areas H are outside the boundary line 31 as indicated by oblique lines, and the inside portion of the non-screening areas H, as shown in FIG. 4, are outside of the sphere with the radius R1 and flat and the thickness T2 is greater than the standard thickness Tf.

As described above, in the CRT for projecting 2 according to the present invention, the four corners of the display area 14, of the panel 11 are located outside of the boundary line 31 and inside of a radius E. The inside portion of the non-screening areas H is outside of the radius R1 and flat. The thickness of the non-screening area H is greater than the standard thickness Tf. Accordingly, the effective screening area A2 can be made larger while maintaining necessary strength.

Further, when displaying two types of video images with different aspect ratios, it is possible to efficiently utilize the panel 11 by reducing to the extent possible the non-screening areas, if set up as described below.

Figure 6:
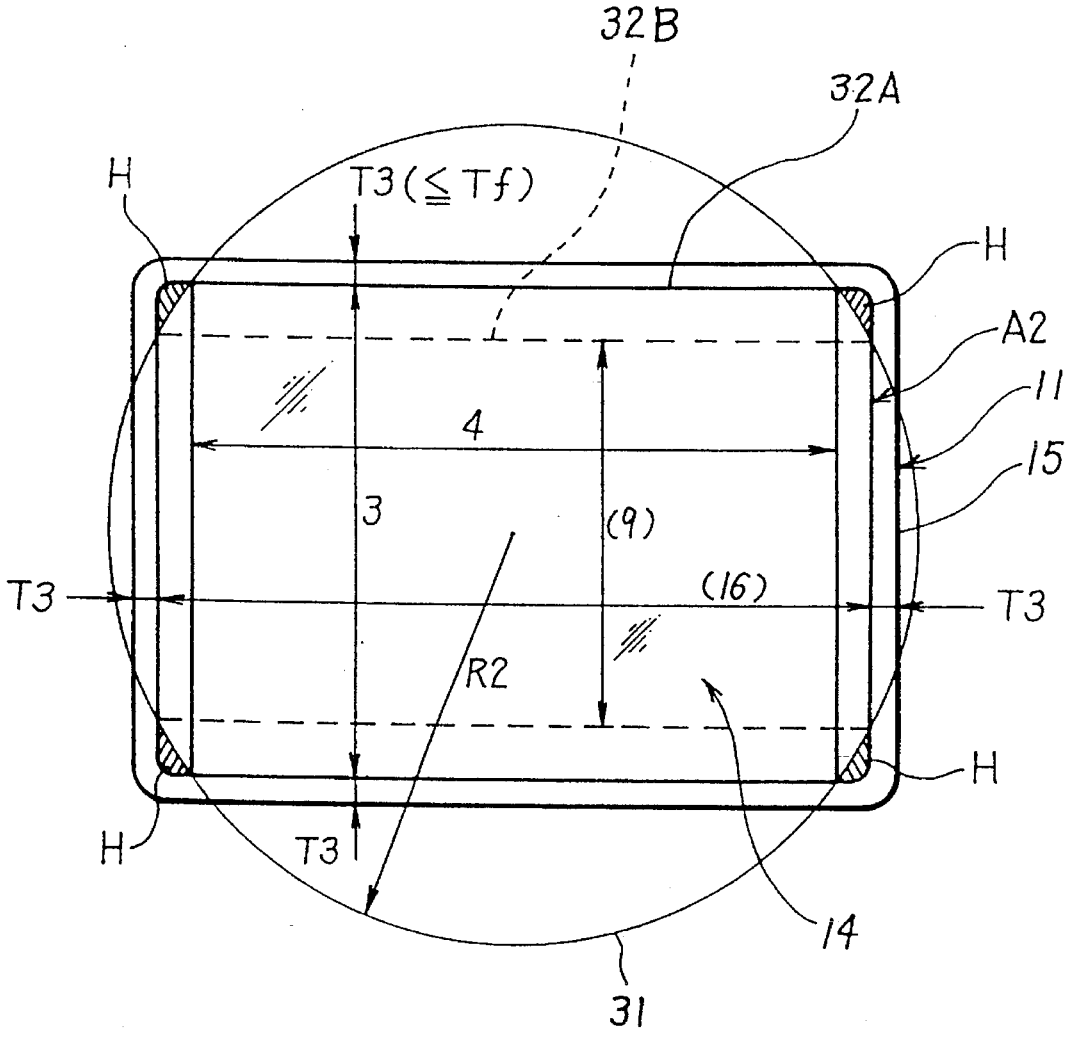
FIG. 6 is a diagram for explaining the method of determining the effective screening area in accordance with two types of aspect ratios.

As shown in FIG. 6, a first effective screening area 32A is set with its four corners at the circumference of the boundary line 31, so that the panel 11 displays a video image at an aspect ratio 4:3. A second effective screening area 32B is set to fall at right angles with the first effective screening area 32A so that the panel 11 displays a video image at an aspect ratio 16:9. In this case, the effective screening area A2 corresponds to the outline consisting of the four outer lines of the effective screening areas 32A or 32B, in other words, the upper and lower side lines of the first effective screening area 32A and the right and left side lines of the second effective screening areas 32B the right and left side lines are at a distance D from the center line C (FIG. 5).

Figure 7:
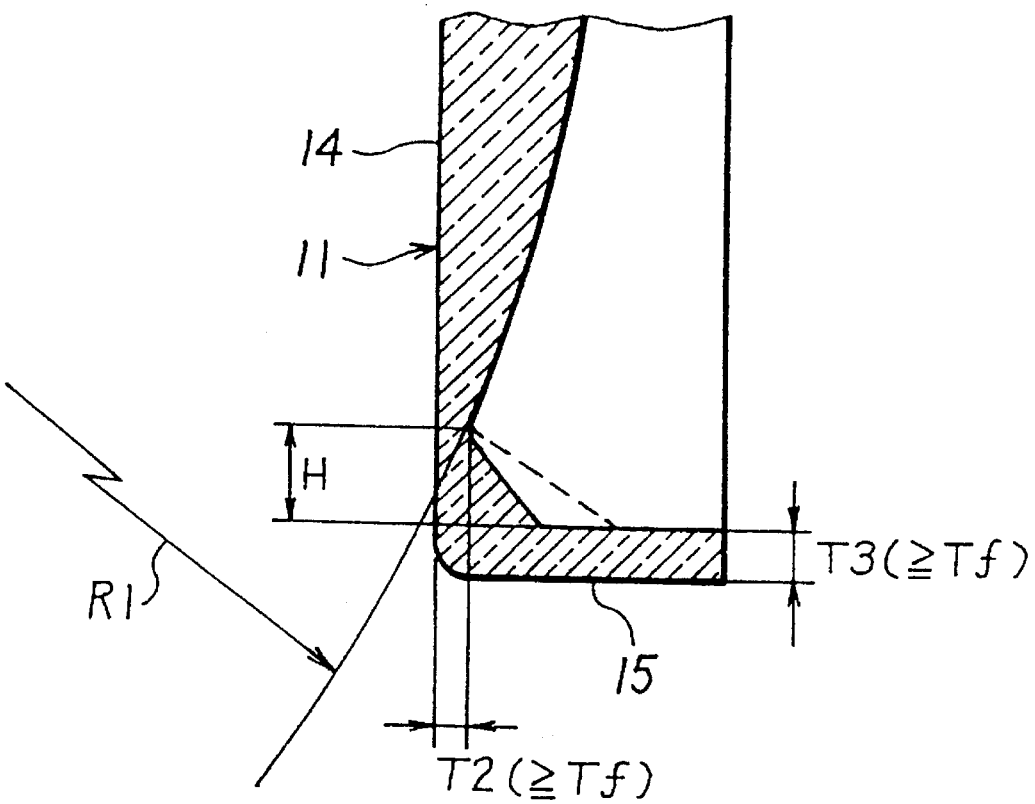
FIG. 7 is a diagram illustrating the sectional view of a portion of the panel in the second embodiment.

Although, in the above embodiment, the inside portion of the non-screening areas H is flat, it may also protrude outside of the sphere with the radius R1 as drawn with a solid or broken line in FIG. 7.

As described above, in the CRT for projecting 2 according to the present invention, the inside portion of the effective screening area protrudes inward in arc shape, extending in all directions, with a predetermined radius, and has a greater thickness than a predetermined standard thickness. The inside portion of the non-screening area, which is outside said effective screening area, is outside of the circle of radius and flat or protuberant, and has a greater thickness than the predetermined standard thickness. Accordingly, through this invention, the effective screening area can be made larger than the conventional types while maintaining necessary strength.

While the preferred embodiment of the invention has been described above, it will be understood that various modifications may be made thereto, and the invention is intended to cover with the appended claims all such modifications as may fall within the true spirit and scope of the invention.

What is claimed is:

1. A cathode ray tube apparatus, comprising:

a panel formed such that an inside portion of an inner surface of said panel forms an effective display area that displays video images;

said inside portion that forms said effective display area protruding inward along an arc shape at a predetermined radius; and an inside portion of a non-display area of the inner surface of said panel being located outside of said effective display area, and being outside of the arc shape formed by said predetermined radius.

2. The cathode ray tube apparatus in accordance with claim 1, wherein said effective display area has boundaries comprising:

upper and lower boundaries for a first effective display area which displays video images of a first aspect ratio; and right and left boundaries for a second effective display area which displays video images of a second aspect ratio.

3. The cathode ray tube apparatus in accordance with claim 2, wherein said non-display area is set outside a circle circumscribed about said first effective display area with its center at a center of said panel.

4. The cathode ray tube apparatus in accordance with claim 2, wherein said non-display area is set in four corners of said panel, outside said effective display area which has said first and second aspect ratios.

5. The cathode ray tube apparatus in accordance with claim 1, wherein a thickness of a boundary line between said effective display area and said non-display area is equal to a predetermine standard thickness.

6. The cathode ray tube apparatus in accordance with claim 1, wherein said inside portion of the non-display area is flat.

7. The cathode ray tube apparatus in accordance with claim 1, wherein said inside portion of the non-display area is protuberant.

8. A cathode ray tube apparatus, comprising:

a front panel having an inner surface, said inner surface having a first display area and a second non-display area;

said first display area having a convex shape that protrudes inward along an arc shape having a predetermined radius and center of curvature;

said second non-display area extending from said first display area so as to be a greater distance from said center of curvature than said predetermined radius.

9. The cathode ray tube apparatus according to claim 8, wherein said first display area comprises upper and lower boundaries for defining a display having a first aspect ratio, and right and left boundaries for defining a display having a second aspect ratio.

10. The cathode ray tube apparatus according to claim 9, wherein said first aspect ratio is 3:4 and said second aspect ratio is 9:16.

11. The cathode ray tube apparatus according to claim 9, wherein said front panel is generally rectangular with four corners, and said second non-display area is located in said four corners.

12. The cathode ray tube apparatus according to claim 11, wherein said second non-display area is generally flat and coplanar.

13. The cathode ray tube apparatus according to claim 8, wherein said second non-display area extends from said first display area radially outwardly and rearwardly with respect to a front surface of said front panel.

* * * * *